US005730321A

United States Patent [19]

McAllister et al.

[11] Patent Number: 5,730,321

[45] Date of Patent: Mar. 24, 1998

[54] GLOW-IN-THE-DARK WATER EMITTERS

[76] Inventors: Todd McAllister, 1039 Golden Rd., Encinitas, Calif. 92024; John Frangos, 13745 Mango Dr., Del Mar, Calif. 92014; Michael Latz, 4962 Smith Canyon Ct., San Diego, Calif. 92130

[21] Appl. No.: 572,243

[22] Filed: Dec. 13, 1995

[51] Int. Cl.[6] ..... G01F 11/00

[52] U.S. Cl. ..... 222/1; 222/79; 222/394

[58] Field of Search ..... 222/1, 79, 394, 222/399; 446/405, 473

[56] References Cited

U.S. PATENT DOCUMENTS

| | | | |
|---|---|---|---|
| 3,005,495 | 10/1961 | Herberg | 222/79 X |
| 4,765,510 | 8/1988 | Rende | 222/79 |
| 4,863,690 | 9/1989 | Berthold et al. | 422/52 |
| 5,022,565 | 6/1991 | Sturman et al. | 222/399 X |
| 5,141,869 | 8/1992 | Steele et al. | 435/291 |
| 5,184,755 | 2/1993 | Brovelli | 222/79 |
| 5,241,944 | 9/1993 | Rappaport | 124/67 |
| 5,264,906 | 11/1993 | Ferer et al. | 356/28 |
| 5,415,151 | 5/1995 | Fusi et al. | 124/56 |

FOREIGN PATENT DOCUMENTS

| | | | |
|---|---|---|---|
| 2172578 | 9/1986 | United Kingdom | 222/399 |

OTHER PUBLICATIONS

Latz et al. (1994) Excitation of bioluminescence by laminar fluid shear associated with simple Couette flow. Limnol. Oceanogr 39, 1424–1439.

*Primary Examiner*—Joseph Kaufman

*Attorney, Agent, or Firm*—Richard Aron Osman

[57] ABSTRACT

The invention relates to methods, compositions and apparatuses, such as squirt guns and of the water emitting devices, that eject a flow of aqueous fluid having visible bioluminescence, providing "glow-in-the dark" emissions. The devices contain a population of a mechanical stress-stimulatable bioluminescent organisms, such as Pyrocystis species such as *lunula* and *fusiformis*, in suspension in a fluid. The fluid luminesces when ejected from an aperture of the device. The devices may also include a fluid flow generator, such as a mechanical pump, capable of inducing the flow of the fluid through the flow path and a trigger or valve capable of activating said fluid flow generator. In addition, the invention provides containers for viably storing populations of the bioluminescent organisms, methods and media for culturing and diluting the organisms, and kits of an emitter, a storage apparatus, suitable bioluminescent organisms, and culture media. The storage apparatuses may include a time-cycled light source capable of periodically illuminating the organisms and a solid or semisolid nutrient medium capable of supporting their viability and growth.

13 Claims, 5 Drawing Sheets

GLOW-IN-THE-DARK WATER EMITTERS

INTRODUCTION

1. Field of the Invention

The field of the invention is squirt guns and other water emitters containing a glow-in-the-dark fluid.

2. Background

Luminescent products have been popular for decades as recreational products, such as glow-in-the-dark toys, ornamental devices, and night safety markers. Luminescent fluids have found use as tracers in a wide variety of applications from health care to environmental monitoring. A commercial luminescent fluid should be amenable a wide variety of applications and provide the luminescent intensity, duration, durability, affordability, etc. to achieve widespread utilization. Furthermore, because many applications involve a likelihood of contact with people or property, any non-contained luminescent fluid should be non-toxic to plants and animals, non-staining on a wide variety of materials including fabrics, cleanable with ordinary solvents such as water, etc. Applications for luminescent fluids have, to date, been very limited because of these constraints.

The present invention provides a practical luminescent fluid for wide a variety of applications, particularly in various emitters. The fluid provides exceptional visibility and durability, is non-toxic and non-staining, is readily removed with water-based household cleaners, and is readily mass-produced at low cost.

3. Relevant Literature

Various colored/luminescent liquid/projectile dispensers are described in U.S. Pat. Nos. 5,415,151; 4,765,510; 2,629,516; 3,472,218. A chemiluminescent squeeze toy is described in U.S. Pat. No. 3,751,846; a chemiluminescent kite is described in U.S. Pat. No. 4,715,564; a phosphorescent toy gel is described in U.S. Pat. No. 5,308,546; a chemiluminescent game ball is described in U.S. Pat. No. 4,930,776; a chemiluminescent golf ball is described in U.S. Pat. No. 4,930,776; a toy having an impact-responsive luminescence is described in U.S. Pat. No. 5,138,535.

Apparatuses for various scientific analyses relating to bioluminescence are described in U.S. Pat. Nos. 5,112,646; 5,141,869; 5,264,906; and 4,863,690. Latz et al. (1994) Limnol. Oceanogr. 39: 1424–1439 report on the excitation of bioluminescence by laminar fluid shear associated with simple Couette flow.

SUMMARY OF THE INVENTION

The invention provides methods and compositions relating to apparatuses, such as toys, for generating luminescent fluid. Generally, the subject devices eject a flow of aqueous fluid having visible luminescence. The disclosed apparatuses may be embodied in a wide variety of devices such as squirt guns, water fountains, and other water emitters such as wands, etc. that provide "glow-in-the dark" emissions, generally for recreational and aesthetic purposes.

In one embodiment, the apparatuses comprise a housing at least partially defining a fluid flow path which includes means for obstructing fluid flow, such as a fluid flow-restricting aperture. The housing is generally pressurizeable to induce the flow of the fluid along the flow path and through the aperture. The housing contains a fluid medium such as a buffered saline which comprises a population of one or more isolated mechanical stress-stimulatable bioluminescent organisms. The population is of size, concentration, activity, etc. such that it is capable of emitting mechanical stress-stimulated bioluminescence visible to an unaided human eye. A number of prokaryotic and eukaryotic microorganisms find use in the subject method, including Pyrocystis species such as *lunula* and *fusiformis*. In operation, a productive flow of the fluid through the flow path is capable of subjecting the population to a mechanical stress sufficient to stimulate bioluminescence of the population visible to the unaided human eye. Frequently, the apparatuses additionally comprise a fluid flow generator, such as a mechanical pump, capable of inducing the flow of the fluid through the flow path and a trigger or valve capable of activating said fluid flow generator.

The invention also provides apparatuses for viably storing populations of the bioluminescent organisms for use in the subject methods and emitters, methods and media for culturing and diluting the organisms, and kits comprising combinations of an emitter, a storage apparatus, suitable bioluminescent organisms, and media and/or media concentrate. The storage apparatuses may include a time-cycled light source capable of periodically illuminating the organisms and/or a solid or semisolid nutrient medium capable of supporting their viability and/or growth.

DESCRIPTION OF THE INVENTION

Figure 1:
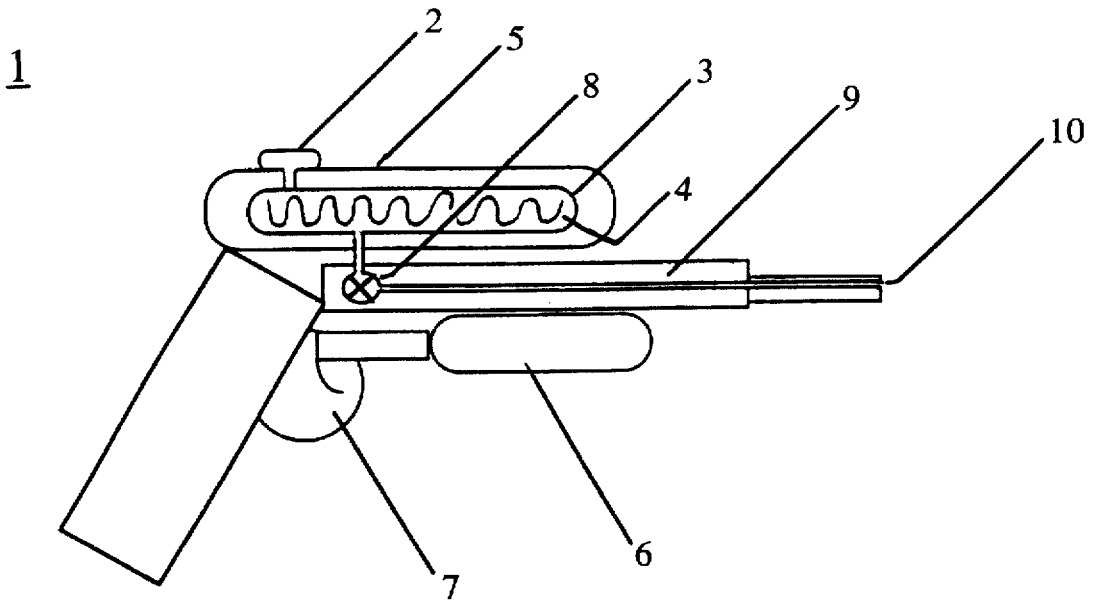
FIG. 1 Squirt gun with mechanical-stress dampening baffles.

The invention provides methods and compositions relating to apparatuses for generating a bioluminescent fluid. The subject methods and compositions find a wide variety of aesthetic and industrial applications where an emitted stream of a mechanically-stimulatable bioluminescence is desired. Some examples include fountains or pools, festival water effects, water-powered rocket launchers, eco-friendly "fireworks". Industrial applications include any application where a night-visible targeting tracer is desired, e.g. night time forest fire water dumps.

In one embodiment, the subject emitters comprise a housing at least partially defining a fluid flow path. The nature of the housing is dictated largely by the application. In any event, the housing should be compatible with the selected bioluminescent microorganisms, e.g. should not provide acute toxicity, and generally provides a light shielding reservoir to contain the microorganisms prior to ejection or emission from the housing. Exemplary housings include or comprise squirt guns and other stream emmiters such as fountains and hoses; spray emitters such as spray bottles and cans, mist-making valves, nozzles, etc.

The housing provides means for obstructing fluid flow, which, in conjunction with the fluid flow, provides the microorganism population interacting with it, e.g. passing around, by or through the obstacle, with mechanical stress or strain sufficient to stimulate the population to the requisite bioluminescence. Exemplary obstacles include a fluid flow-restricting tube or aperture venting the housing to atmospheric pressure, a baffle, etc. A flow that stimulates bioluminescence capable of detection by an unaided human eye is referred to as a productive flow. As used herein, visible to an unaided human eye means capable of being detected by an unaided human eye under optimal conditions, e.g. darkness.

Fluid flow is usually provided by a fluid flow generator, such as a mechanical pump, pressurized gas, etc., capable of inducing the requisite flow of the fluid through the flow path. Alternatively, the housing itself may be compressible to provide pressure to the fluid sufficient to induce the requisite flow. The housing may additionally comprise a trigger or valve capable of activating said fluid flow generator. In many embodiments, the trigger or valve is manually actuated.

The housing contains a fluid medium such as a buffered saline which comprises a population of an isolated mechanical stress-stimulatable bioluminescent organism. The contained fluid is aqueous and supports the physiology of the selected luminescent organism at least to the extent necessary to support the requisite mechanical stress-stimulatable bioluminescence. As such, the fluid generally comprises nutrients sufficient to support the physiology of the selected luminescent organism at least to the extent necessary to support the requisite mechanical stress-stimulatable bioluminescence. The population is of size, concentration, activity, etc. such that it is capable, in the targeted application, of emitting mechanical stress-stimulated bioluminescence visible to an unaided human eye. Generally, the cells are concentrated to at least three times, preferably at least ten times, more preferably at least 100 times, most preferably at least 1,000 times greater than found in natural, free populations. While cells may be concentrated from natural sources, they are preferably grown in in vitro culture. Concentrations are preferably achieved by membrane filtration. In any event, it is important to avoid co-concentrating toxic contaminants or raising the salinity or ionic strength beyond levels compatible with the requisite physiology of the organisms.

The choice of stress-stimulatable microorganism is dictated by the targeted application and convenience, such as rigor, e.g. temperature, fluid media, light and stress tolerances, growth requirements and rate, light wavelength/intensity/longevity, threshold sensitivity, cost, availability, etc. Preferred species can live in a variety of environments while their bioluminescence is dependent on a photosynthetic process. For many applications, preferred cells luminesce optimally on a circadian rhythm of 12 hours light/12 hours dark and it is possible to maintain their circadian rhythm and ability to luminesce on an a few, e.g. as little as one, two or three, hours of light per day. Furthermore, if the cycle is broken for a prolonged period (e.g. days), preferred cells will regain their normal luminescent properties after a few 24 hour light/dark cycles. Preferred cells may be cultured in simple media such as enriched sterile seawater and/or the solid agar media, such as those disclosed herein. In addition to shear stress sensitivity, preferred cells can be engineered to luminesce at a particular point in a fluid stream. Furthermore, natural signal decay and refractory periods can be utilized to generate desired effects. For example, perturbations to the flow may be introduced upstream of the exit aperture such that the housing and the flow path are also illuminated. Because of the finite decay time of the luminescence, the stream would still be visible after exiting the aperture. Conversely, the flow path and exit aperture can be designed such that the mechanical stimulation is minimized. In this case, the luminescence is delayed until either the stream impacts a solid surface or the flow encounters sufficient air drag to trigger the cells.

A number of natural dinoflagellates and dinoflagellate-like marine microorganisms, including Protoperidinium, Noctiluca, Polykrikos, Gonyaulax, Ceratium, and particularly, Pyrocystis species such as *lunula* and *fusiformis*, have proven exceptionally well suited to the subject methods and devices, particularly in applications which preclude the use of potentially pathogenic or otherwise toxic microorganisms. In addition, a variety of microorganisms such as *E. coli* may be transformed with genes encoding proteins which effect bioluminescence and those transformants with mechanical stress-responsive bioluminescence selected, conveniently with automated fluorescence activated cell sorters (FACS).

Solid and semisolid media have been developed for applications of the invention using Pyrocystis species. In a particular embodiment of the media, agar is dissolved into sterilized enriched seawater at a concentration of 0.8%–1.4% and allowed to gel. A concentrated solution of cells is added to the semi solid gel and allowed to solidify in a sealed sterile container. As the agar solidifies, cells are entrapped but maintain their ability to divide and reproduce.

The invention also provides apparatuses for viably storing populations of the bioluminescent organisms for use in the subject methods and emitters, methods and media for culturing and diluting the organisms, and kits comprising combinations of an emitter, a storage apparatus, suitable bioluminescent organisms, and media and/or media concentrate. The storage apparatuses are provided in several configurations. They may include a translucent cartridge or cartridge containing a time-cycled light source capable of periodically illuminating the organisms and/or a solid or semisolid nutrient medium capable of supporting their viability and/or growth. In one embodiment, the storage apparatus is a sealed and sterile liquid container with a transparent or translucent exterior housing. A hydrophobic filter which supports required gas exchange while maintaining a sterile environment. Alternatively, a cartridge having a light-opaque housing may be used. Such cartridges are fitted with an internal light source and timing device capable of maintaining the bioluminescent rhythm of the organisms. The storage cartridges can accommodate semi-solid or solid agar bound cells, e.g. shaped as a coil or pleated sheet, to maximize the light-exposed surface to volume ratio.

EXAMPLES

The following examples are offered by way of illustration and not by way of limitation.

FIG. 1 shows a squirt gun 1 for use in the subject invention. The fluid comprising the bioluminescent organisms is added through a fluid inlet 2 into a mechanical dampening bladder 3 further containing a baffle system 4 to minimize stimulation prior to emission. The bladder 3 is contained within a rigid reservoir housing 5, which is pressurized by a pressurized gas chamber 6. A trigger 7 operates a valve 8 which connects the bladder 3 to a tube 9 which carries the fluid from the bladder 3 to the exit aperture 10.

Figure 2:
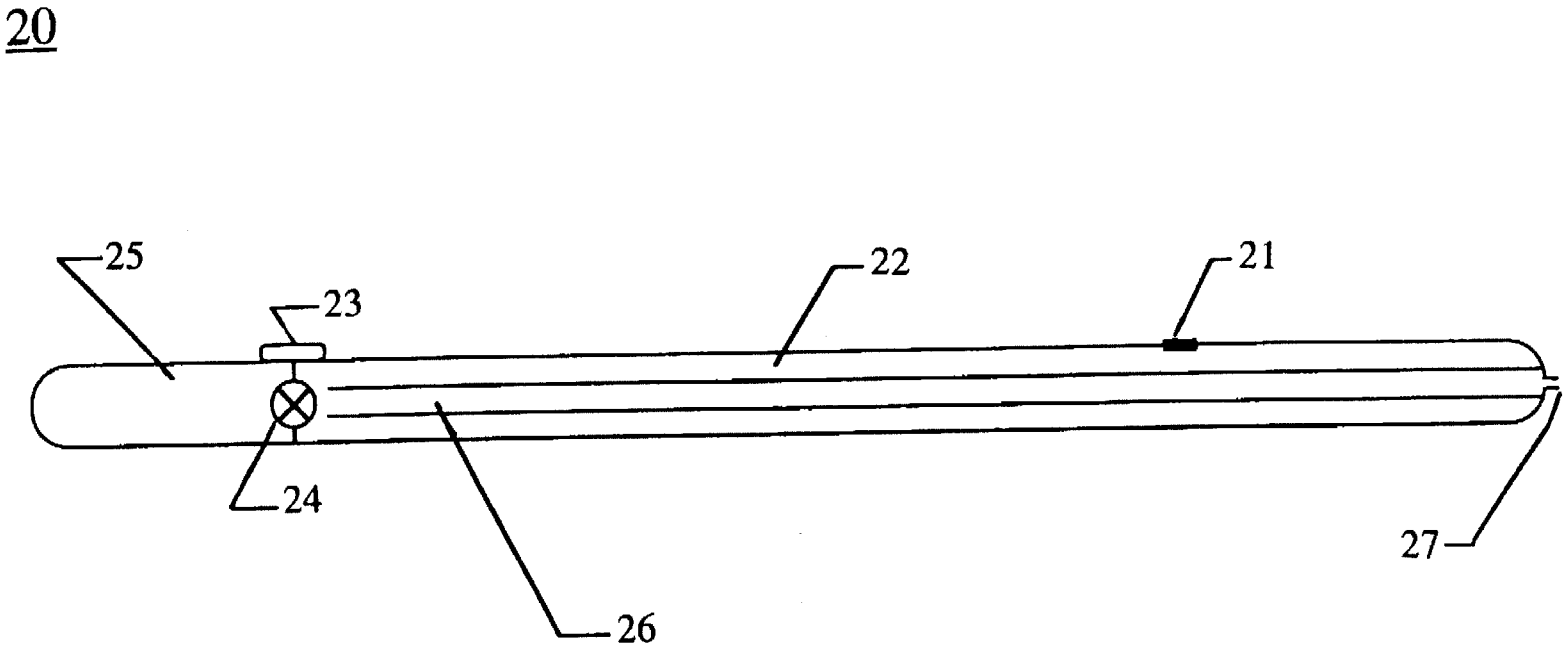
FIG. 2 Pressurized "magic wand"-style fluid emitter.

FIGS. 2 shows a "magic wand" 20 for use in the subject invention. The fluid comprising the bioluminescent organisms is added through a fluid inlet 21 into a fluid reservoir 22. A trigger 23 operates a valve 24 which connects a pressurized chamber 25 to the reservoir 22. Activating the trigger 23 opens the valve 24 causing the fluid in the reservoir 22 to move through a tube 26 which carries the fluid to the exit aperture 27. The exit aperture is designed such that the fluid is vaporized at the exit, creating a luminescent mist surrounding the tip of the wand.

Figure 3:
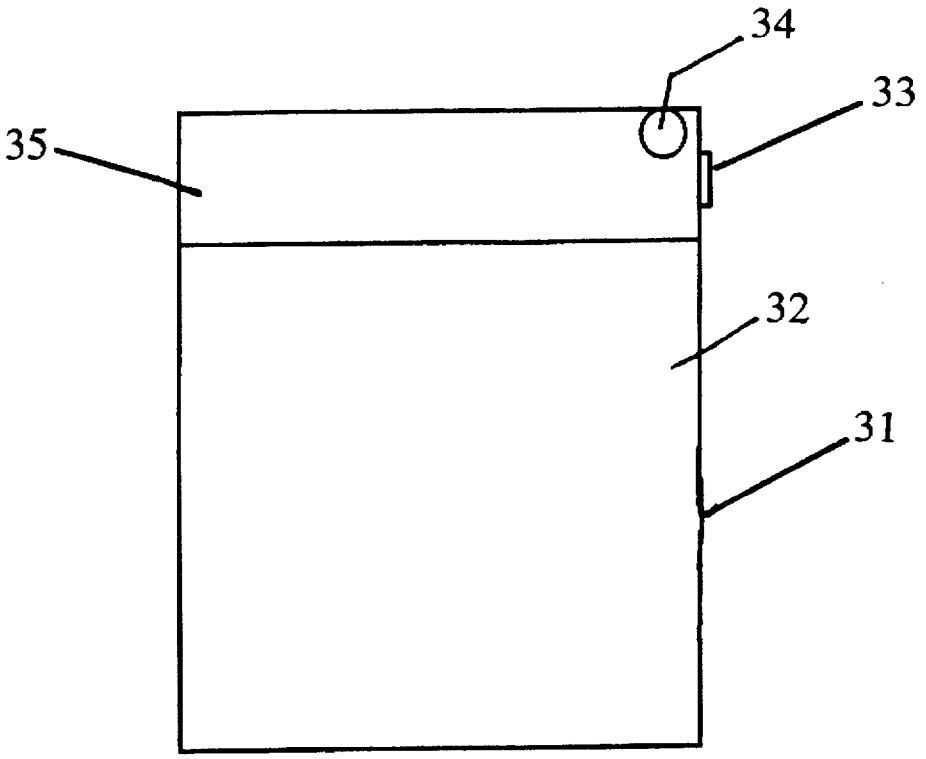
FIG. 3 Non-illuminating storage cartridge for cells in liquid medium.

FIG. 3 shows a non-self-illuminating culture storage cartridge for cells in a liquid medium. The cartridge comprises a sealed clear housing 31 defining a fluid reservoir 32, a gas permeable filter 33 for providing gas exchange to the reservoir 32, a nutrient tablet 34 to provide proper nutrients and osmotic strength to the reservoir upon addition of water thereto. A gas space 35 is maintained to increase gas exchange.

Figure 4:
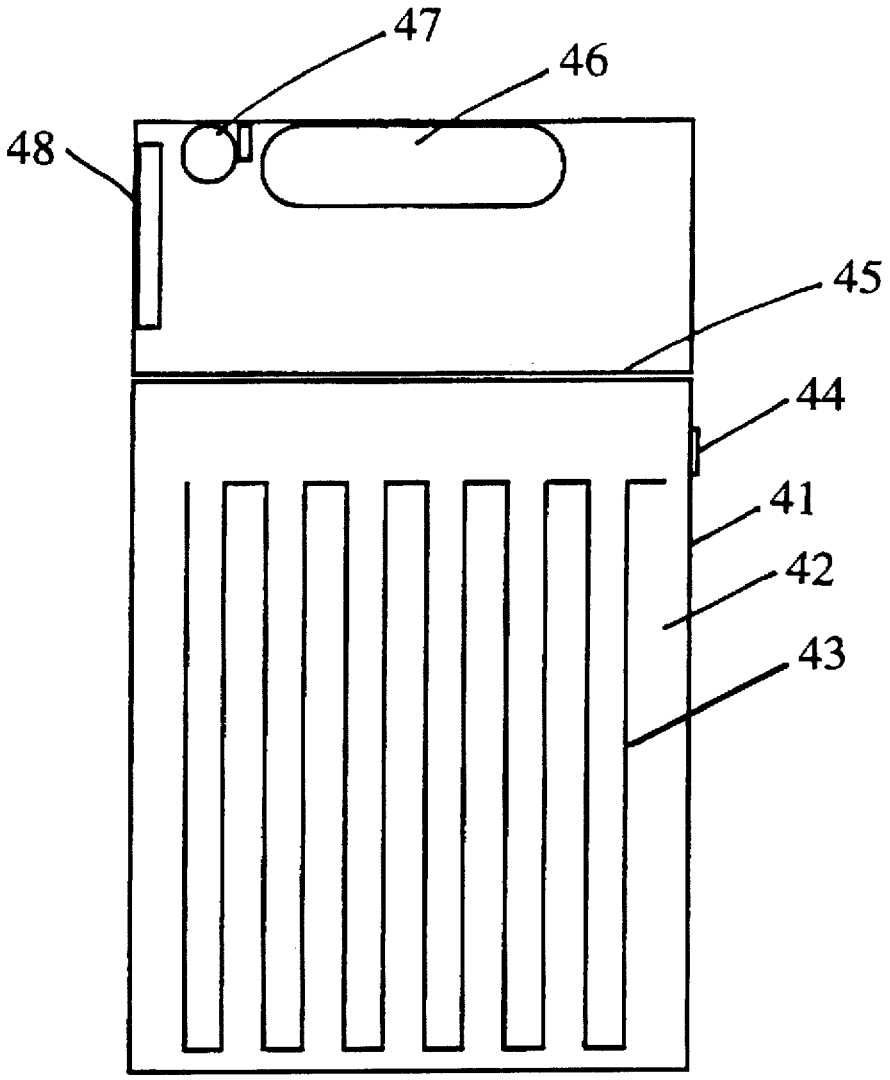
FIG. 4 Light source containing storage cartridge for cells in semi-solid medium.

FIG. 4 shows a self-illuminating culture storage cartridge for cells in a semi-solid medium. This cartridge comprises a sealed housing 41, opaque on all surfaces except that side 45 which faces a light 46. The housing 41 defines a chamber 42 in which is housed a semi-solid medium in which the cells are grown. Gas exchange is provided by a permeable filter 44. The light 46 is controlled by a timing circuit activated switch 47 and powered by a battery 48.

Figure 5:
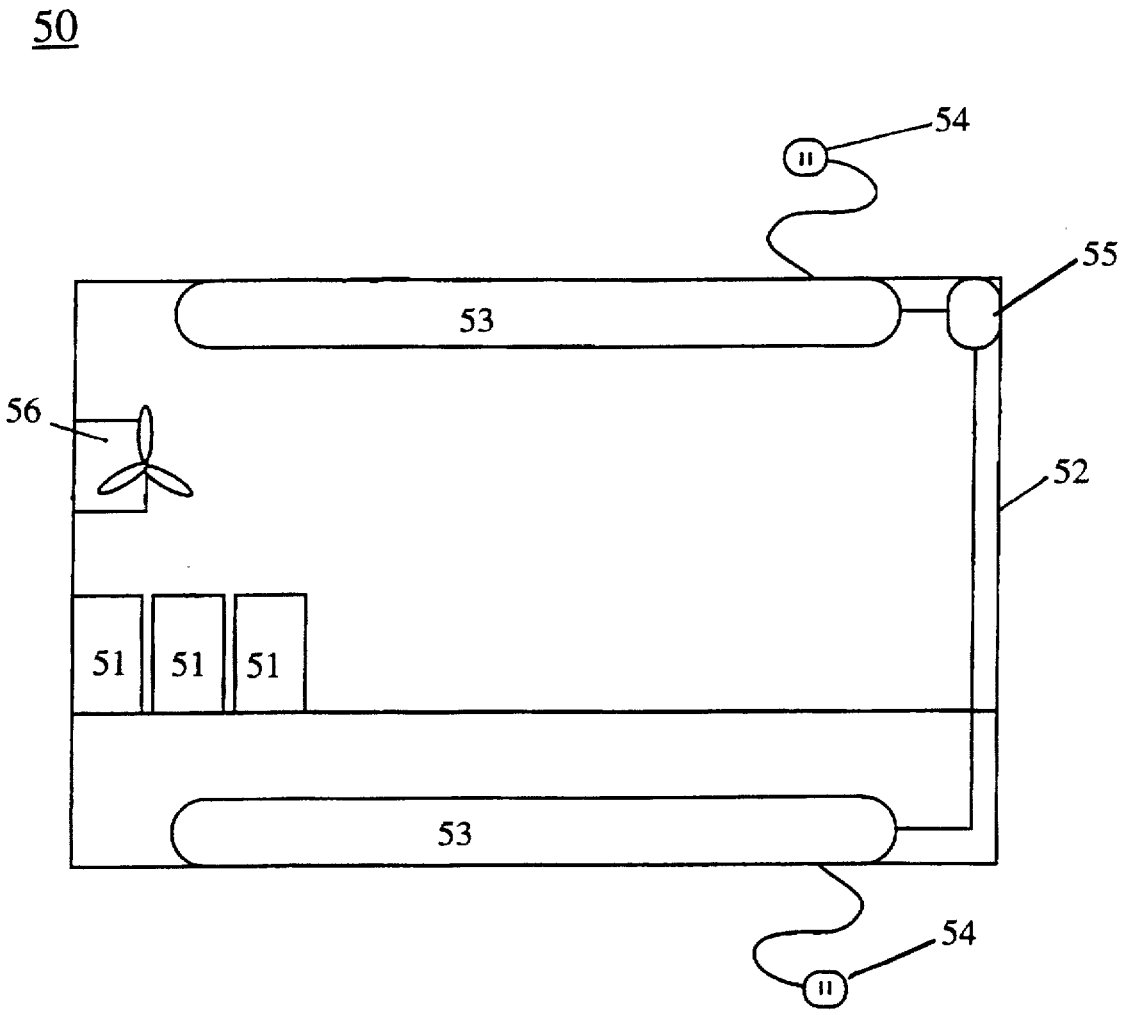
FIG. 5 Illumination box for storing cartridge

FIG. 5 shows an illumination box 50 for storing cartridges 51 which are not self-illuminating. The box comprises an opaque housing 52, banks of lights 53 having a power source 54 and controlled by a timing circuit 55. The temperature in the box is controlled by a temperature control unit 55.

All publications and patent applications cited in this specification are herein incorporated by reference as if each individual publication or patent application were specifically and individually indicated to be incorporated by reference. Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

What is claimed is:

1. An apparatus for generating a luminescent fluid, said apparatus comprising:

a pressurizeable housing at least partially defining a fluid flow path comprising an aperture capable of venting said housing to atmospheric pressure, and containing a fluid, said fluid comprising a population of an isolated mechanical stress-stimulatable bioluminescent organism, said population capable of emitting mechanical stress-stimulated bioluminescence visible to an unaided human eye, wherein a productive flow of said fluid through said flow path is capable of subjecting said population to a mechanical stress sufficient to stimulate bioluminescence of said population visible to said unaided human eye wherein said apparatus is a squirt gun, a fountain, or a wand.

2. An apparatus according to claim 1 further comprising a fluid flow generator capable of inducing said flow of said fluid through said flow path.

3. An apparatus according to claim 1 further comprising a fluid flow generator capable of inducing said flow of said fluid through said flow path and a trigger capable of activating said fluid flow generator.

4. An apparatus for generating a luminescent fluid, said apparatus comprising: a pressurizeable housing at least partially defining a fluid flow path comprising means for obstructing fluid flow and containing a fluid, said fluid comprising a population of an isolated mechanical stress-stimulatable bioluminescent organism, said population capable of emitting mechanical stress-stimulated bioluminescence visible to an unaided human eye, wherein said obstructing means is capable of subjecting said population to a mechanical stress sufficient to stimulate bioluminescence of said population visible to said unaided human eye when said fluid moves through said flow path wherein said apparatus is a squirt gun, a fountain, or a wand.

5. An apparatus according to claim 4 further comprising a fluid flow generator capable of inducing said flow of said fluid through said flow path.

6. An apparatus according to claim 4 further comprising a fluid flow generator capable of inducing said flow of said fluid through said flow path and a trigger capable of activating said fluid flow generator.

7. A method for generating a luminescent fluid, said method comprising the step of moving a fluid comprising a population of an isolated mechanical stress-stimulatable bioluminescent organism, said population capable of emitting mechanical-stimulated bioluminescence visible to an unaided human eye, from a first pressurized region through a fluid flow path comprising an aperture to a second region at atmospheric pressure whereby said population is subject to a mechanical stress sufficient to stimulate bioluminescence of said population visible to said unaided human eye.

8. A method according to claim 7 wherein said moving step is effected in part by a mechanical fluid flow generator.

9. A method according to claim.7 wherein said moving step is effected in part by a mechanical fluid flow generator and said mechanical fluid flow generator is activated by a trigger.

10. A kit comprising:

(a) a first apparatus for generating a luminescent fluid, said apparatus comprising a housing at least partially defining a fluid flow path comprising an aperture capable of venting said housing to atmospheric pressure, and capable of containing a fluid, said fluid comprising a population of an isolated mechanical stress-stimulatable bioluminescent organism, said population capable of emitting mechanical stress-stimulated bioluminescence visible to an unaided human eye, wherein a productive flow of said fluid through said flow path is capable of subjecting said population to a mechanical stress sufficient to stimulate bioluminescence of said population visible to said unaided human eye;

(b) a second apparatus for viably storing said population of an isolated mechanical stress-stimulatable bioluminescent organism.

11. A kit according to claim 10 wherein said second apparatus comprises a time-cycled light source capable of periodically illuminating said population of an isolated mechanical stress-stimulatable bioluminescent organism.

12. A kit according to claim 10, wherein said second apparatus comprises a solid or semisolid nutrient medium capable of supporting the viability of said population of an isolated mechanical stress-stimulatable bioluminescent organism.

13. A kit according to claim 10, wherein said first apparatus is a squirt gun, a fountain, or a wand.

* * * * *